US009799308B2

(12) United States Patent
Apodaca

(10) Patent No.: US 9,799,308 B2
(45) Date of Patent: Oct. 24, 2017

(54) FINGERBOARD PROTECTOR FOR STRINGED MUSICAL INSTRUMENTS

(71) Applicant: Mark Anthony Apodaca, Santa Fe, NM (US)

(72) Inventor: Mark Anthony Apodaca, Santa Fe, NM (US)

(73) Assignee: Mark Anthony Apodaca, Santa Fe, NM (US)

( * ) Notice: Subject to any disclaimer, the term of this patent is extended or adjusted under 35 U.S.C. 154(b) by 105 days.

(21) Appl. No.: 14/698,074

(22) Filed: Apr. 28, 2015

(65) Prior Publication Data

US 2016/0322033 A1 Nov. 3, 2016

Related U.S. Application Data

(60) Provisional application No. 61/992,177, filed on May 12, 2014.

(51) Int. Cl.
*G10D 3/06* (2006.01)
*G10D 1/00* (2006.01)

(52) U.S. Cl.
CPC ..... *G10D 3/06* (2013.01); *G10D 1/00* (2013.01)

(58) Field of Classification Search
CPC ..... G10D 3/06; G10D 1/08; G10D 1/00
USPC ..... 84/267, 290, 293
See application file for complete search history.

(56) References Cited

U.S. PATENT DOCUMENTS

| | | | | |
|---|---|---|---|---|
| 6,452,080 | B1 | 9/2002 | Coerce | |
| 7,238,870 | B2 | 7/2007 | Stewart | |
| 8,704,066 | B2 * | 4/2014 | Jacobsen | G09B 15/008 84/477 R |
| 2006/0174748 | A1 * | 8/2006 | Buhoveckey | G10D 3/06 84/314 R |

OTHER PUBLICATIONS

LinkedIn.com indicates that David Jacobsen is the CEO of Fretdaddy, LLC.
www.fretdaddy.com website makes reference to U.S. Appl. No. 2012-0,167,746 which makes reference to U.S. Appl. No. 8,704,066 B2 which states David Jacobsen the inventor.

* cited by examiner

*Primary Examiner* — Kimberly Lockett

(57) ABSTRACT

Disclosed is a fingerboard protector for stringed musical instruments which demonstrates a novel solution to the problem of fingerboard wear caused by the players fingers making contact with the fingerboard. This physical contact in addition to the natural acidity of the players fingers can wear down the fingerboard creating indentations as well as contaminating the fingerboard with tarnish and grime. In the case of a fretless instrument, the strings are pushed directly into the fingerboard causing wear to occur at a much faster rate. My present invention sets out to solve this problem by creating a fingerboard protector safeguarding it from undesirable wear during normal playing of the instrument. The ease of installation and removal will appeal to musicians who want to protect their instrument as well as give it a new and unique look.

8 Claims, 5 Drawing Sheets

FIGURE 3
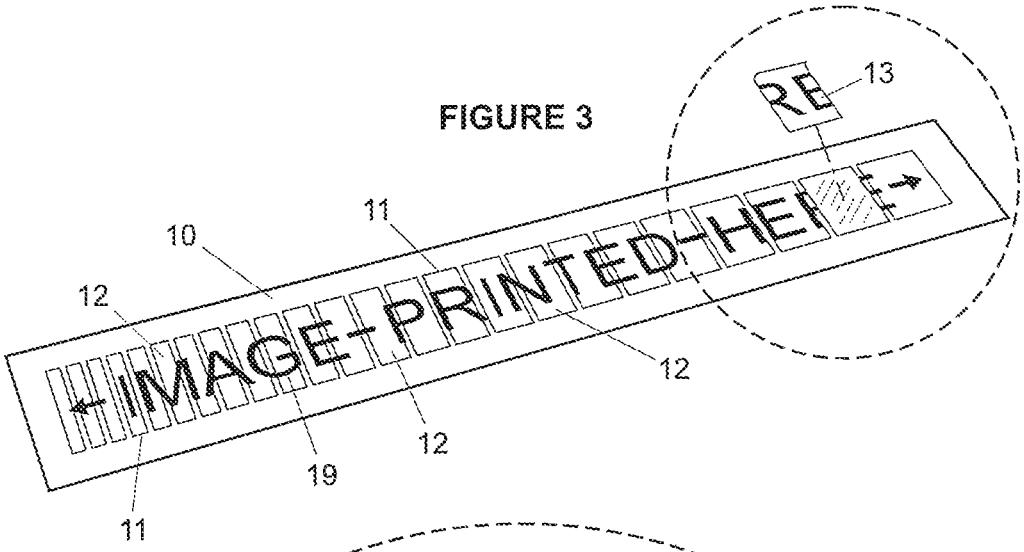
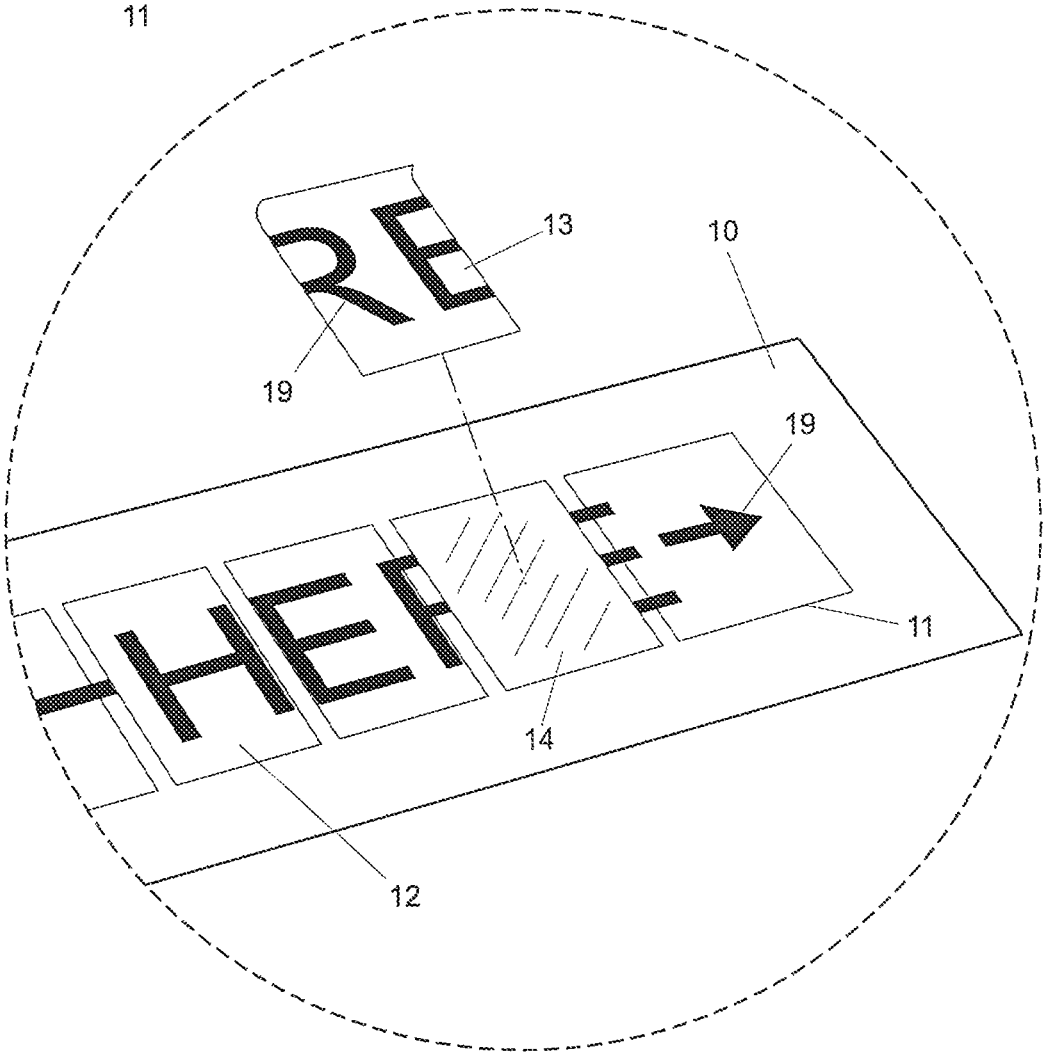
FIGURE 4

FINGERBOARD PROTECTOR FOR STRINGED MUSICAL INSTRUMENTS

CROSS REFERENCE TO RELATED APPLICATION

This application claims the benefit of U.S. Provisional Application No. 61/992,177, filed May 12, 2014, which is incorporated herein by reference.

BACKGROUND OF THE INVENTION

1. Field of the Invention

An apparatus and method for protecting the fingerboard of a stringed musical instrument from the natural acidity and friction of the players fingers that can cause damage and wear to the fingerboard during normal playing of the instrument.

2. Description of the Prior Art

Stringed musical instruments that embody fingerboards, such as guitars, bass guitars, ukuleles, mandolins, banjos, violins, fiddles and cellos are all susceptible to damage and wear merely by being played by a musician. While playing these types of instruments, the musician must apply pressure and push the instruments strings into the frets and the fingerboard to create notes or chords. This physical contact in addition to the natural acidity of the players fingers can wear down the fingerboard creating indentations as well as tarnishing the fingerboard with friction and grime. In the case of a fretless instrument, the strings are pushed directly into the fingerboard causing the wear to occur at a much faster rate. This embodiment sets out to solve this problem by creating a protective barrier between the players fingers and the fingerboard, safeguarding it from undesirable wear during normal playing of the instrument as well as giving the instrument a unique new look.

U.S. Pat. No. 7,238,870, to Stewart, entitled "Enhanced Fret Saving Device and Process" (2007) describes a specialized at least bilayered device similiformic with the fretboard/fingerboard/keyboard of an instrument is designed to be removingly disposed between the strings and fretboard or frets of the instrument and prevents or mitigates fret damages (from, for example, dimpling or string grooving) owing to string pressures, such as during transport and storage of the instrument in a case or other. Fret integrity and active or functional life is extended in an industrially efficient, economical and elegant way heretofore uncontemplated and/or commercially realized.

This prior art is limited to only protecting the frets of an instrument only when the instrument is not being played, such as during transport and storage or while the instrument is in a case or otherwise and makes playing the instrument impossible while the prior art is installed on the instrument. This embodiment creates a protective barrier between the players fingers and the fingerboard, safeguarding it from undesirable wear while the instrument is being played by the musician.

U.S. Pat. No. 8,704,066, to Jacobsen, entitled "Removable Fretboard Stickers With Musical Indicia" (2014) describes a device and method for teaching note locations, fretboard patterns, scales and chords on the fingerboard of a fretted stringed instrument ("fretboard"), such as an electric or acoustic guitar. The invention comprises a set of independently affixable fretboard adhesive labels ("Stickers") that adhere to the surface of the stringed instrument, using a mild adhesive, so as not to damage the instrument, and a number of markings, which indicated musical indicia. The device is applied to the instrument by slipping the various individual stickers between the corresponding frets and strings of the stringed instrument and affixing the stickers directly to the fretboard.

Even though the prior art embodies affixable fretboard adhesive labels ("stickers") to be installed directly to the fretboard of the stringed instrument, the primary object of this prior art is to create a visual device to aid students in learning the location of various musical concepts and features. The prior art calls for the "stickers" to be installed and removed in sets according to what musical concept the student is learning. By either removing or not installing certain sets of "stickers", the prior art allows areas of the fingerboard to remain uncovered, thus exposing those areas to the natural acidity and friction of the players fingers that can cause damage and wear to the fingerboard during normal playing of the instrument. A great disadvantage of the prior art that I have found, calls for an amount of the "sticker" to be folded over the edge of the fingerboard as to grip the sides of the neck of the instrument. I have found that any amount of a "sticker" that extends onto the sides of the neck of the instrument is prone to peeling and interfering with the players hand movements while it travels up and down the neck during normal playing of the instrument. This embodiment does not interfere with the musicians ability to play the instrument, whereas it is applied only to the face of the fingerboard and does not overlap onto the neck of the instrument. Because the prior art calls for the height of the "stickers" to be smaller than the distance between the frets, as shown on FIG. 3, large areas of the fingerboard are left exposed. Thus the prior art is not suitable as a protective barrier but merely a teaching tool. This embodiment is designed to be used during normal playing of the instrument thereby creating a protective barrier which protects the fingerboard from the natural acidity and friction of the players fingers that can cause damage and wear to the fingerboard. This embodiment will not affect the sound quality of the instrument.

U.S. Pat. No. 6,452,080, to Coonce, entitled "Note Locator for Stringed Instruments" (2002) describes an apparatus and method for a note locator for stringed instruments and method of use. Note locator (10) comprises a flexible planar top and bottom surface wherein the top surface has note position indicators (60) of color and the bottom surface has an adhesive for placement beneath the strings of the instrument along the fingerboard without interfering with the normal operation of the instrument. The user learns correct finger placement by visually identifying colors with notes of the equitempered chromatic scale. Diatonic scale note position indicators (32, 36, 38, 42, 46, 50 and 52) are indicated with various distinct colors while other half step note position indicators (30, 34, 40, 44 and 48) are indicated with a color different from that of the diatonic scale note position indicators. Segmentation (70,72) is provided for dividing note locator (10) so that segments can be added or removed from the fingerboard if desired.

Although the prior art embodies a thin vinyl, or similarly flexible top material with an adhesive bottom surface that is to be installed onto an instruments fingerboard, the primary objective of the prior art is to precisely indicate to the player the location on the strings where the notes are to be played. It is stated in the summary of the prior art, that segmentations means are provided for dividing the note locator so that segments can be added or removed from the fingerboard if desired. By removing segments from the fingerboard, the prior art exposes areas of the fingerboard to the natural acidity and friction of the players fingers that can cause damage and wear to the fingerboard during normal playing of the instrument. Although the prior art is not stating itself to be a fingerboard protector, I have found that it would have a great disadvantage as a fingerboard protector due to the suggested removal of segments of the prior art from the fingerboard, thus exposing said areas of the fingerboard to the natural acidity and friction of the players fingers that can cause damage and wear to the fingerboard during normal playing of the instrument. I have found another disadvantage of the prior art which calls for sufficient additional material for overhang, to wrap around the fingerboard to stabilize the device on the curved fingerboard of the instrument. I have found that any amount of material that extends onto the sides of the neck of the instrument is prone to peeling and interfering with the players hand movements while the players hand travels up and down the instruments neck during normal playing of the instrument. This embodiment does not interfere with the musicians ability to play the instrument, whereas it is applied only to the face of the fingerboard and does not overlap onto the neck of the instrument. This embodiment will not affect the sound quality of the instrument.

SUMMARY OF THE INVENTION

This present invention applies to a variety of stringed instruments including guitars, bass guitars, ukuleles, mandolins, banjos, violins, fiddles and cellos that incorporate a fingerboard. Typically there are two types of fingerboards. Those that encompass frets, referred to fretted fingerboards and fingerboards that do not encompass frets which are referred to as fretless fingerboards. Normal playing of these types of instruments requires that the player use their fingers to apply pressure to the strings and push them into the frets and the fingerboard to create notes or chords. This physical contact in addition to the natural acidity of the players fingers can wear down the fingerboard creating indentations as well as contaminating the fingerboard with tarnish and grime. In the case of a fretless instrument, the strings are pushed directly into the fingerboard causing the wear to occur at a much faster rate.

When installed onto the fingerboard, this embodiment is designed to be used during normal playing of the instrument thereby creating a protective barrier which protects the fingerboard from the natural acidity and friction of the players fingers that can cause damage and wear to the fingerboard. This embodiment is easy to install and easy to remove without causing any damage to the fingerboard. This embodiment is designed to not interfere with the musicians ability to play the instrument or affect the sound quality of the instrument. This embodiment is also a means for greatly extending the life and integrity of an instruments fingerboard helping to prevent costly replacement or repairs.

BRIEF DESCRIPTION OF THE DRAWINGS

FIG. 3 provides an isometric view of this embodiment indicating one of the fingerboard protector decals being removed from its backing paper.

FIG. 4 provides an enlarged isometric view of FIG. 3.

DETAILED DESCRIPTION OF THE INVENTION

1. Definitions

"Fingerboard" as used herein shall refer to both a fretted fingerboard (which incorporates frets) or a fretless fingerboard (which does not incorporate any frets).

"Fingerboard protector" as used herein shall refer to this embodiment.

"Material" as used herein shall refer to a material comprising of distinct layers.

The first or top layer incorporates a low-tack adhesive on its underside and will act as a protective barrier. The second or bottom layer is a backing layer that protects the adhesive of the top layer until installation of the decals is initiated.

"Ornamental" as used herein shall refer to a non-essential graphic or image that is incorporated onto this embodiment. It is strictly for visual appeal to the said invention and does not affect the objective of this embodiment in any way.

"Decals" as used herein shall refer to the individual pieces or in the case of a fretless fingerboard, a single piece of this embodiment that is to be installed onto the fingerboard of the instrument.

"Contour" as used herein shall refer to the cut lines that are created by a contour cutter.

"Backing" as used herein shall refer to the bottom layer of the material that is used for protecting the adhesive layer of this embodiment before it is installed onto the fingerboard of the instrument.

2. Best Mode of the Invention

Figure 6:
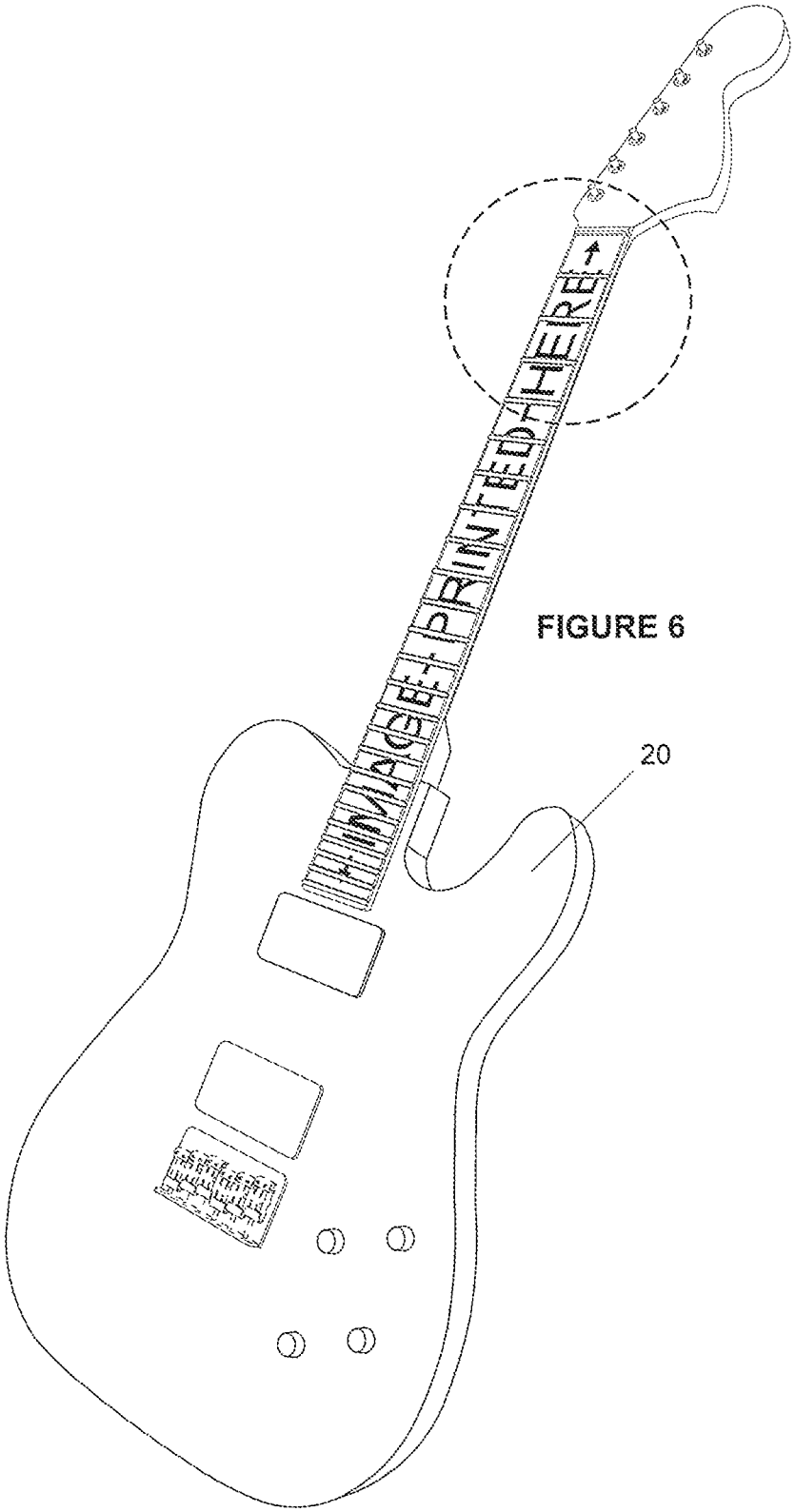
FIG. 6 illustrates an isometric view of the fingerboard protector decals completely installed onto the fingerboard of the instrument. The instruments strings have been omitted to further enhance the clarity of the drawings.

FIG. 6 illustrates an isometric view of the best mode contemplated by the inventor of the fingerboard protector for musical instruments according to the concepts of this embodiment

3. How to Make the Invention

Figure 1:
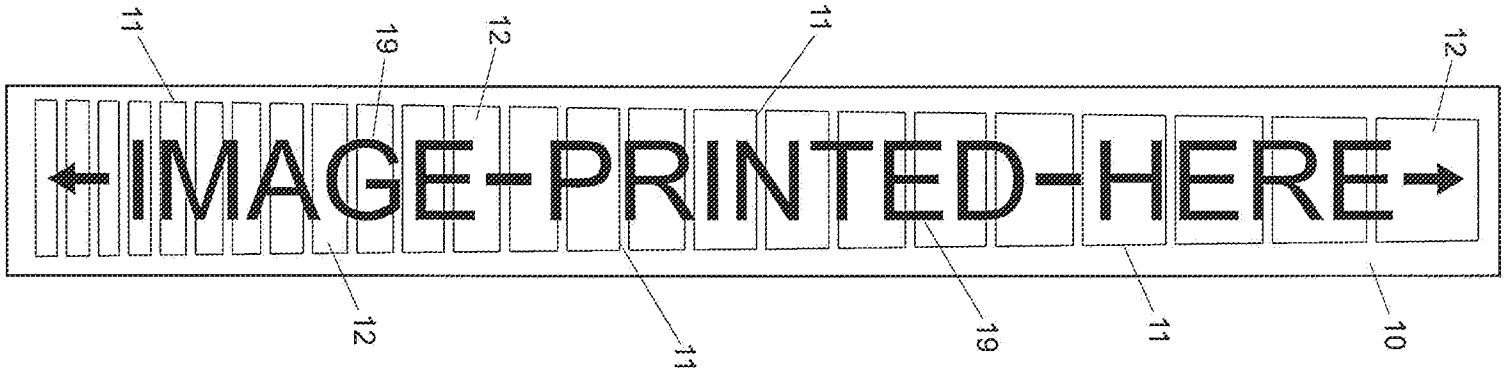
FIG. 1 provides a frontal view of this embodiment. The words "IMAGE-PRINTED-HERE" demonstrates an optional ornamental design incorporated onto the protector and is for illustrative purposes only and should not be construed as limiting the optional ornamental designs of this embodiment.
Figure 2:
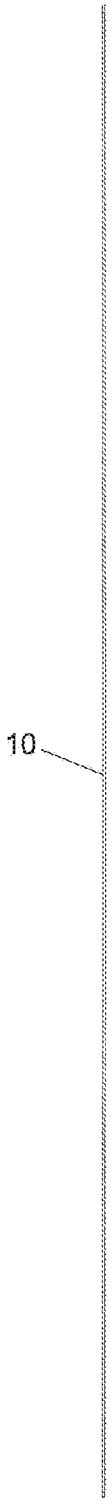
FIG. 2 provides a side view of the of this embodiment.
Figure 5:
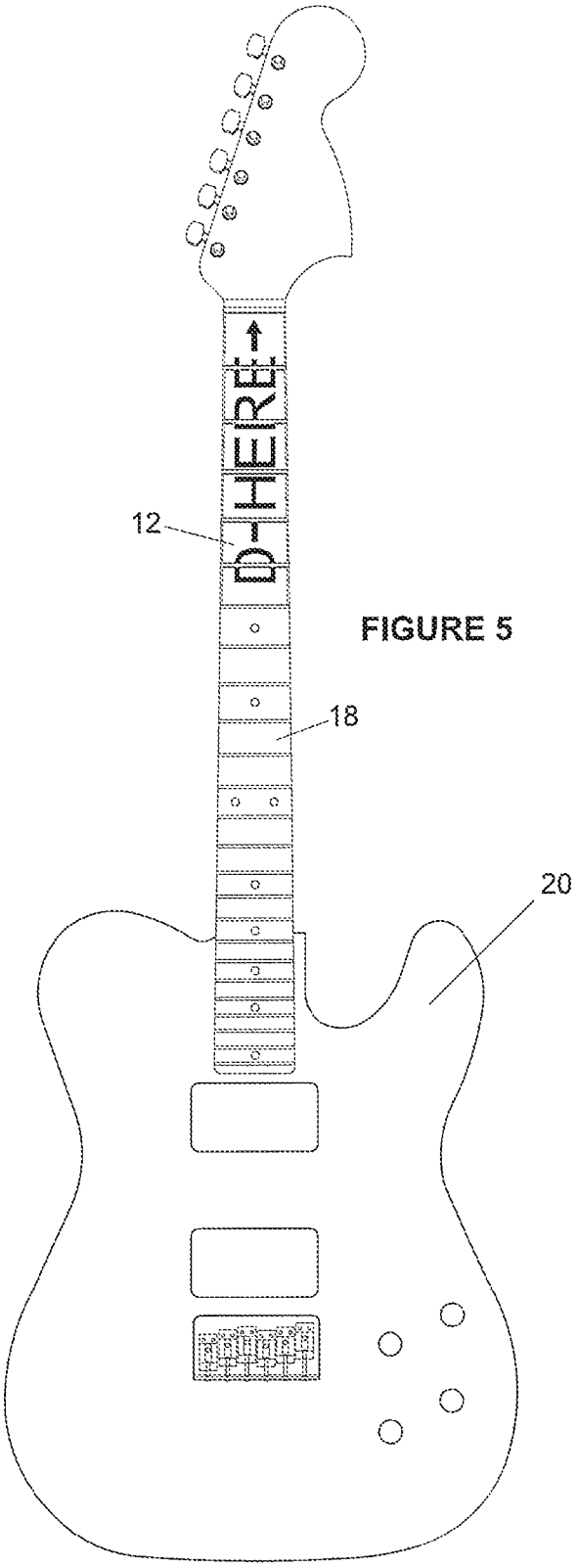
FIG. 5 illustrates a frontal view of a fretted electric guitar with some of the fingerboard protector decals installed. The instruments strings have been omitted to further enhance the clarity of the drawings.

This embodiment comprises of a set of fingerboard protector "decals" 12 as shown on FIG. 1, that are designed to cover the greater part of a stringed musical instruments "fingerboard" 18 as shown on FIG. 5. These "decals" 12 would peel away from the protective "backing" layer 14 as shown on FIG. 4, and adhere to the surface of the "fingerboard" 18 as shown on FIG. 5, using a low-tack, pressure sensitive adhesive that is repositionable and removable. This would create a protective barrier between the players fingers and the fingerboard, safeguarding it from the natural acidity and friction of the players fingers that can cause damage and wear to the fingerboard during normal playing of the instrument. As shown on FIG. 1, optional "ornamental" graphic designs 19 can be incorporated onto the "fingerboard protector" "decals" 12, as shown on FIG. 1, so as to display an image across the length and width of the fingerboard giving the instrument a new and unique look. This embodiment is easy to install and easy to remove without causing any damage to the fingerboard and is also designed to not interfere with the musicians ability to play the instrument and will not affect the sound quality of the instrument.

Anyone who is skilled in the musical arts and the art of computer graphics and vinyl sign production would be able to reproduce this invention based on this detailed specification.

Stringed instruments such as such as guitars, bass guitars, ukuleles, mandolins, banjos, violins, fiddles and cellos all have different shapes and sizes of fingerboards. Those skilled in the musical arts will understand that the various dimensions of the fingerboards can be measured for a custom fitted fingerboard protector. For the purpose of this specification, a standard six string electric guitar that incorporates a fretted fingerboard 20, as shown on FIG. 5, will be described.

The optional "ornamental" design 19, as shown on FIG. 1, would vary in proportion and size to accommodate the specific size of the "fingerboard" 18, as shown on FIG. 5, depending on the musical instrument. It could be created on a computer using photographic or image design software such as Adobe Photoshop® or taking a hand drawn image and scanning it into digital form using a high resolution scanner. This "ornamental" design 19 could comprise of but not be limited to, photographic images, panoramic photos, works of art, proper names and verbiage, exotic wood grains, decorative marker dots, authorized licensed images and advertising.

After the "ornamental" design 19 has been created, it would then be transferred onto the protective "material" 10 using any of the industries standard printing techniques, including but not limited to, offset printing, digital printing, screen printing, flexography, gravure printing and ink jet printing. As shown on FIG. 4, the said "material" 10 would comprise of at least two layers, the first or top layer of the "material" 10 will have a low-tack adhesive on the underside of the top layer, the second or bottom layer is the "backing" layer 14, as shown on FIG. 4, that protects the low-tack adhesive on the underside of the top layer until it is ready to be peeled away 13, as shown on FIG. 4, from the "backing" layer 14 as shown on FIG. 4, and installed onto the "fingerboard" 18 of the musical instrument. This "material" 10 should include certain properties such as, non-stretch, water resistant, not prone to flaking or smearing. It should incorporate a low-tack pressure sensitive adhesive on the underside of the top layer that is both repositionable and removable, it would be thin enough as to not interfere with the musicians ability to play the instrument or to affect the sound quality of the instrument, it could easily be removed from the "fingerboard" 18 of the instrument without causing any damage to the fingerboard and have the durability to act as a protective barrier. An example of such "material" 10 would be a polypropylene material in a matte or gloss finish that is commonly used in the signage industry.

If printing the optional "ornamental" design 19 onto a matt "material" 10, a further option would be to cover the "material" 10 with a clear polypropylene or like, which would give this embodiment a clear gloss look, as well as provide additional protection to the printed image.

The first or top layer of the "material" 10 would then be cut into a shape that would fit a particular instruments "fingerboard" 18, in this example, a standard six string electric guitar 20, as shown on FIG. 5. This type of cutting is accomplished using a contour cutter that is standard to the vinyl signage industry. The "fingerboard" measurements would be entered into the contour cutters software program to make the desired cuts 11, as shown on FIG. 1. The cutter would only cut through the top layer of the "material" 10 without cutting all of the way through the bottom protective "backing" layer 14 by means of adjusting the cutting depth and cutting pressure of the contour cutter, this is a standard technique in the signage industry. This technique would produce correctly sized "decals" 12 for a particular instruments "fingerboard" 18 by means of the cut lines 11. The "decals" 12 will remain together as a group as shown on FIG. 1, until the individual pieces are ready to be peeled away from the "backing" layer 14 and installed onto the "fingerboard" 18 of the stringed musical instrument.

Figure 7:
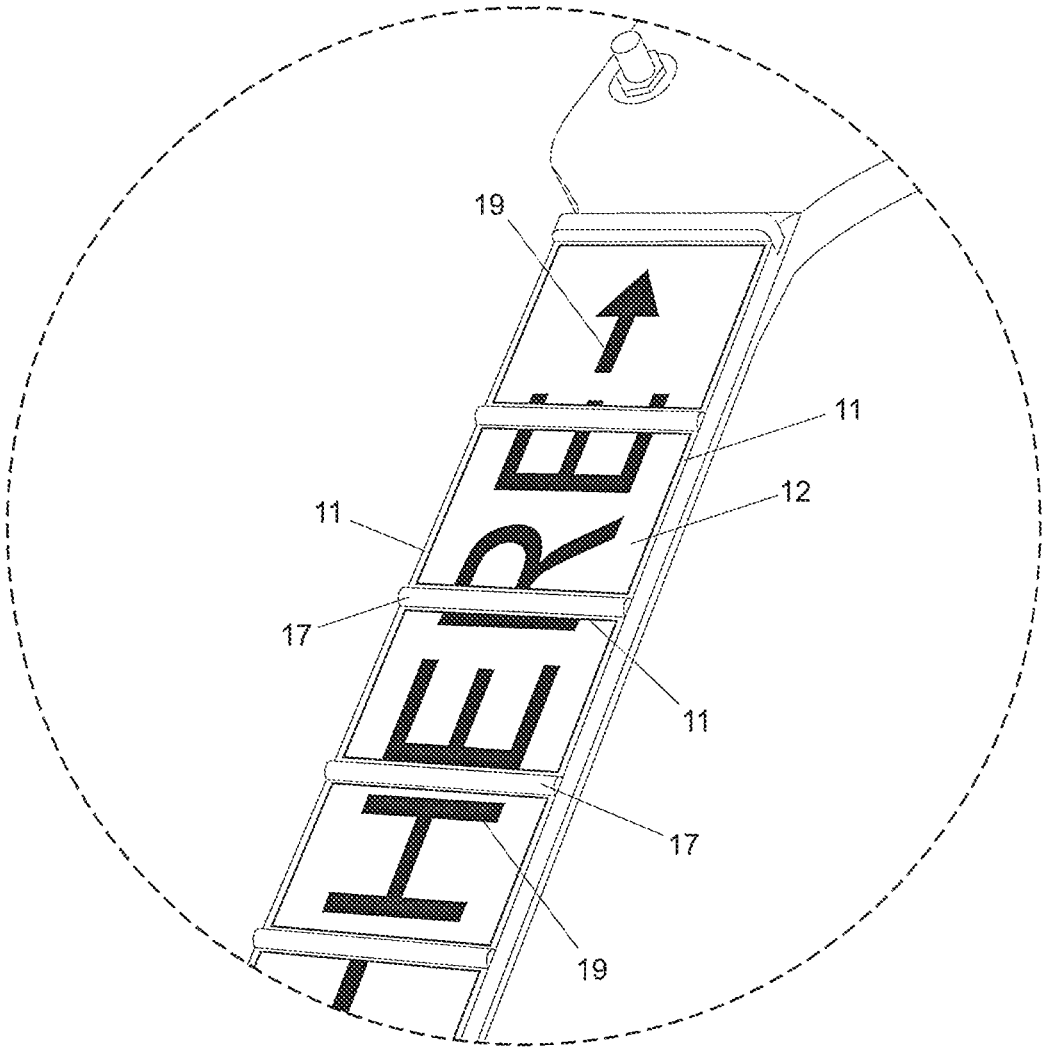
FIG. 7 illustrates an enlarged isometric view of FIG. 6.

FIG. 7 demonstrates the cut lines 11, that run parallel to the "fingerboard" are designed so that a small gap is created from the outer edge of the fingerboard to the edge of the protective "decals" 12, this gap is created so the decals will not interfere with the movement of the players hands and fingers as they travel up and down the length of the neck. The cut lines 11, as shown on FIG. 7, that run perpendicular to the fingerboard, are cut to allow the "decals" 12, as shown on FIG. 7, to fit precisely between the frets 17, as shown on FIG. 7, leaving little or no gap between the edge of the decals and the edge of the frets. This establishes coverage to the majority of the face of the fingerboard thereby protecting the fingerboard from the natural acidity and friction of the players fingers that can cause damage and wear to the fingerboard during normal playing of the instrument.

4. How to Use the Invention

The user would install the appropriately sized fingerboard protector by gaining access to the "fingerboard" 18 by simply loosening the tension on the strings and pulling them aside or during a string change when the strings are completely removed from the instrument. In the example of the electric guitar 20, the user would then peel away a single "decal" from the protective "backing" layer 14 as shown on FIG. 4 and position it onto the applicable location between the frets 17 of the "fingerboard" as shown on FIG. 7. The "decals" 12 could be re-lifted and repositioned by the user to allow for the correct positioning onto the "fingerboard". This process would continue until the "fingerboard" is covered by means of this embodiment as shown in FIG. 6. The "fingerboard" is now protected and the user would then retune the instrument and play it as normal.

Any musician who can change their strings will find this embodiment is easy to install and easy to remove without causing any damage to the fingerboard. A great advantage to the use of this embodiment is that it will protect the fingerboard while not interfering with the musicians ability to play the instrument. Another great advantage to the present invention is that it will not affect the sound quality of the instrument in any way. Musicians around the world will find this embodiment to be a very affordable means for greatly extending the life and integrity of their instruments fingerboard, helping to prevent costly replacement or repairs while also providing a unique and personalized look to the instrument.

The above description is presented to enable a person skilled in the art to make and use the invention, and is provided in the context of a particular application and its requirements. Various modifications to the preferred embodiments will be readily apparent to those skilled in the art, and the generic principles defined herein may be applied to other embodiments and applications without departing from the spirit and scope of this embodiment. Thus, this embodiment is not intended to be limited to the description as shown, but is to be accorded the widest scope consistent with the principles and features disclosed herein. In this regard, certain embodiments within the invention may not show every benefit of the invention, considered broadly.

What is claimed is:

1. A fingerboard protector for stringed musical instruments, comprising: a fingerboard protective decal, the decal further comprising a single trapezoid shape, said decal would cover only a string-facing side of a instrument fingerboard, such that the protector does not interfere with playing of the instrument, provides protection for the fingerboard during traditional playing of the instrument by shielding the fingerboard from natural acidic properties of a musicians fingers and hands, the protector further shielding against wear to the fingerboard created by friction due to movement and force of fingertips during traditional playing of the instrument.

2. The fingerboard protector for stringed musical instruments according to claim 1, further comprising a plurality of said decals sized to cover the fingerboard between frets on a fretted stringed instrument.

3. The fingerboard protector for stringed musical instruments according to claim 1, wherein the decals of the protector are affixed to a fingerboard using a microspheric pressure sensitive adherent that allow the decals to be removed easily over course of life of the decal.

4. The fingerboard protector for stringed musical instruments according to claim 1, wherein the microspheric pressure sensitive adherent comprised of microspheric bonding particles sized to limit physical contact between the decals and a fingerboard.

5. The fingerboard protector for stringed musical instruments according to claim 1, wherein the decals are comprised of a polypropylene material.

6. The fingerboard protector for stringed musical instruments according to claim 1, wherein the decals further comprise a backing layer protecting the microspheric pressure sensitive adherent prior to use until installation has commenced.

7. The fingerboard protector for stringed musical instruments according to claim 1, further comprising an applied luminescent ornamental ink wherein the protector exhibits luminescence ability to absorb energy and emit as visible light.

8. The fingerboard protector for stringed musical instruments according to claim 5, wherein the polypropylene material is fibrous.

* * * * *